United States Patent [19]

Jahn

[11] 4,340,316

[45] Jul. 20, 1982

[54] BINDING SYSTEM

[76] Inventor: Gerhard Jahn, 896 Queen St. West, Toronto, Ontario, Canada, M6J 1G6

[21] Appl. No.: 162,445

[22] Filed: Aug. 4, 1980

[51] Int. Cl.[3] ..... B42F 13/12

[52] U.S. Cl. ..... 402/68; 402/61; 402/64; 402/80 P

[58] Field of Search ..... 402/61, 68, 60, 64, 402/80 P

[56] References Cited

U.S. PATENT DOCUMENTS

| | | | |
|---|---|---|---|
| 1,517,712 | 12/1924 | Davie | 402/64 |
| 3,083,714 | 4/1963 | Foster | 402/64 |
| 3,260,264 | 7/1966 | McKowen | 402/61 X |
| 3,574,472 | 4/1971 | Cott | 402/61 X |

*Primary Examiner*—Paul A. Bell
*Assistant Examiner*—John S. Brown

[57] ABSTRACT

A binding arrangement according to the present invention comprises a post projecting from one side of the arrangement and an opening having a blind ended mouth surrounded by a mouth wall for releasably securing the head of the post at the other side of the arrangement. The mouth is narrower and longer than the head which is stiff for forceably opening the mouth when it is inserted or removed from the secured position. The head has an undercut base for receiving the mouth wall when the head is locked in the opening. The overall arrangement is adapted to provide outward lateral flexing and inward lateral rebounding of the mouth wall at the undercut base of the head for removably securing the head in the opening.

13 Claims, 7 Drawing Figures

FIG.1.
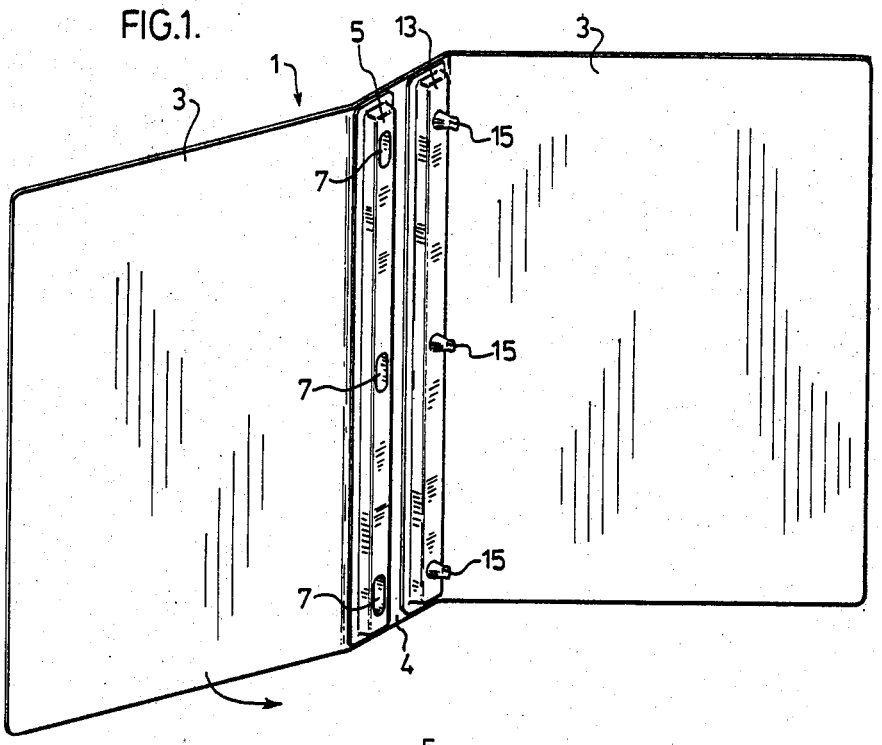
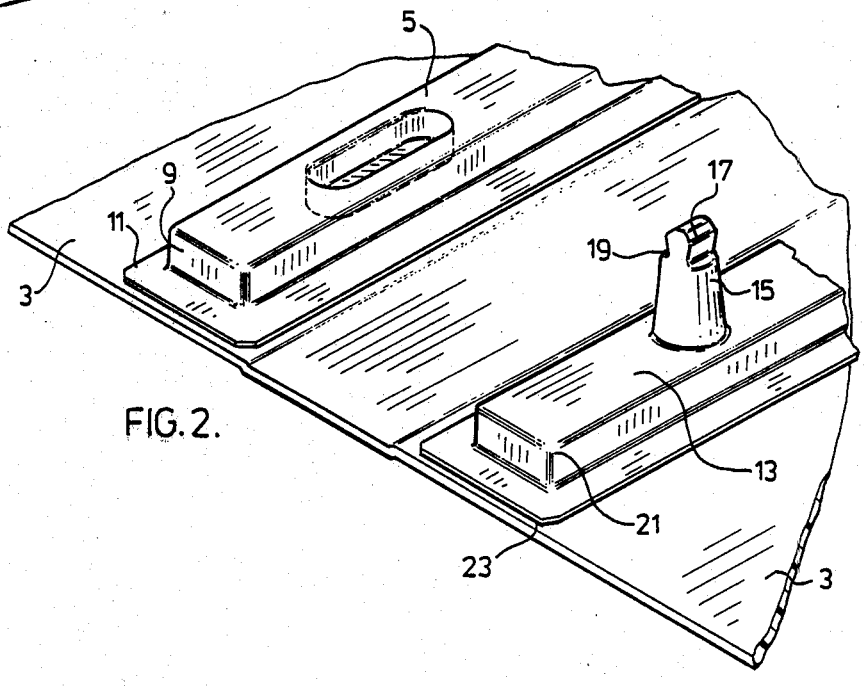
FIG. 2.

BINDING SYSTEM

FIELD OF THE INVENTION

The present invention relates to a binding arrangement in which a post is provided on one side of the arrangement and an opening is provided on the other side of the arrangement for releasably securing the post when in the binding position.

BACKGROUND OF THE INVENTION

There are presently available on the market today a wide range of folders ranging from the very low priced up to the more expensive ring binder type folder. These folders fall in two basic categories which are the loose leaf version and the permanently bound type version where it is difficult, if not impossible, to add or change sheets without requiring special machines.

According to the former version with which the present invention is concerned, there are presently available a number of different types of loose leaf folders. For example, there are the folders comprising paper covers and metal tangs sold under the trade marks DUOTANG and ACCO FASTENERS. There is also available that plastic clamp type loose leaf folder which uses an extruded plastic slide bar in the form of a U-shaped channel used to bind sheets together. Both of the above type systems are somewhat difficult to work with. In the duotang-type system, the tangs or fasteners are deformed after numerous uses and in the latter slide bar-type bar system, the bar must be tightly locked in position in which case the sheets are tightly held at the binding edge and resist opening. Any pressure to open the pages tends to dislodge the slide bar from its binding position.

Another system of which most people are aware of is the ring-type binder. However, again, the ring binder is high in cost and is generally not acceptable for use with only 20 to 30 pages.

A very easy and inexpensive system is the ball and socket or dome-type arrangement as shown in U.S. Pat. No. 3,768,838 issued Oct. 30th, 1973 to Shibata. According to the Shibata system, as well as most other conventional dome systems, a generally rounded head is secured into a generally rounded opening of lesser diameter than the head. The head itself is collapsible either as a result of the material from which the head is made or due to the provision of slots in the head which permit its inward collapsing as it is forced into the opening. However, because either the head or the socket opening or both are relatively resilient to permit fastening, the securing is not often as positive as is required to effectively bind the arrangement together. Furthermore, anyone who has worked with these dome-type fasteners will appreciate that if the head is not perfectly aligned with the socket getting the two to mate with one another can be quite a job, since there is no tolerance from this alignment.

The latter mentioned misalignment difficulty has been overcome according to U.S. Pat. No. 3,574,472 issued Apr. 13th, 1971 to Reliure Industrielle S.T.D. According to U.S. Pat. No. 3,574,472 the head of a post is elastically engaged in an open ended undercut recess. Since both the head of the post or stud and the recess walls are of an elastic nature, the securing action is not as positive as that of a stiffer material. Furthermore, the continuous nature of the recess substantially decreases from its strength and its locking action on the head of the post.

The present invention relates to a binding system comprising a post provided with a head projecting from one side of the system and an opening having a blind ended mouth surrounded by a mouth wall for releaseably securing the head of the post at the other side of the system. The mouth is narrower and at the same time longer than the head with the head being stiff for forceably opening the mouth during insertion therein and removal therefrom and having an undercut base for receiving the mouth wall when the head is locked in the opening. The arrangement is adapted to provide outward lateral flexing of the mouth wall as the head is forced therethrough and inward lateral rebounding of the mouth wall at the side undercut base of the head when the head is releaseably secured within the opening without having to provide resilient material at the mouth wall.

As a result of the nature of the binding system in which soft flexible materials are not required to operate the system, there is an extremely positive locking action on the head of the post. Furthermore, since the mouth is elongated relative to the head and due to the fact that the head will lock when received anywhere in the opening, there are very little alignment problems compared to the standard dome-type fastener. However, it is to be understood that the mouth is not continuous and is completely surrounded by the mouth wall which substantially adds to the locking action of the mouth wall on the post head.

BRIEF DESCRIPTION OF THE DRAWINGS

The above as well as other advantages and features of the present invention will be described in greater detail according to the preferred embodiments of the present invention wherein:

FIG. 1 is a front plan view of a loose leaf folder incorporating a binding arrangement according to a preferred embodiment of the present invention;

FIG. 2 is an enlarged top perspective view showing a partial section of the binding arrangement of FIG. 1;

Figure 3:
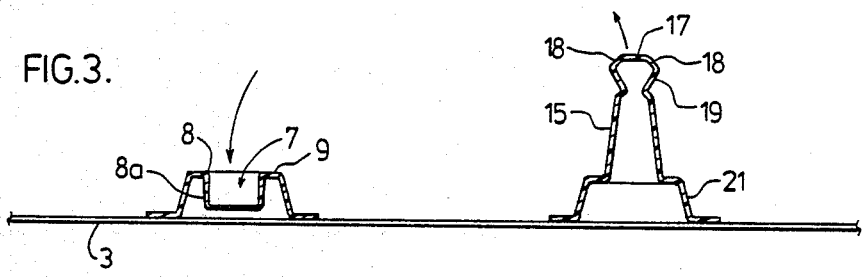
FIGS. 3 through 5 are side sectional views of the binding arrangement shown in FIG. 2.

DETAILED DESCRIPTION OF THE PREFERRED EMBODIMENTS ACCORDING TO THE PRESENT INVENTION

The binding system shown in the drawings is used on a file folder generally indicated at 1. The folder itself comprises a pair of relatively flexible panels 3 secured to one another at a flexible spine 4. The two panels easily fold about the spine and the folder itself is preferably made from a vinyl material which may consist of a single layer of vinyl over the entirety of the folder or a reinforced layer of material at the covering panels.

Heat sealed to the panels on either side of the spine are a pair of elongated stiffened strips 5 and 13. The preferred arrangement is the one shown in the drawings in which strip 5 is on the front cover panel and strip 13 is on the rear cover panel although the strips may be reversed.

Strip 5 comprises a raised body portion 9 which presents outwardly extending flanges 11. Provided directly in the raised body portion are three grooved openings 7 having blind ended mouths each of which is bounded by a mouthwall 8.

Strip 13 on the other hand, comprises a body portion 21 presenting outwardly extending flanges 23. Provided along body portion 21 are three posts 15 each of which is provided with a head 17 having an undercut base 19. The ridge or body portion on strip 5 has a depth more than adequate to fully receive the heads of the posts. Both of the strips are heat sealed at their respective flanges to the folder.

Each of the strips may be made from Twenty Thousand PVC material of the frozen food grade which is shatter-proof to a temperature of −40° C. This particular grade of material resists cracking under normal wear and is much stronger than regular PVC which for reasons described below, makes this material particularly suited for the present invention.

Each of the strips is heat sealed to its respective panel and positioned on one side of the flexible spine such that the heads of the posts are generally centrally aligned with the mouths of the strip on the opposing panel. It will be appreciated that there is adequate spacing between the two strips to permit full folding of the folder. Furthermore, because the strips are initially cut at the same length, proper positioning of each strip is extremely easy by simply aligning the strip with the edge of the folder.

Figure 4:
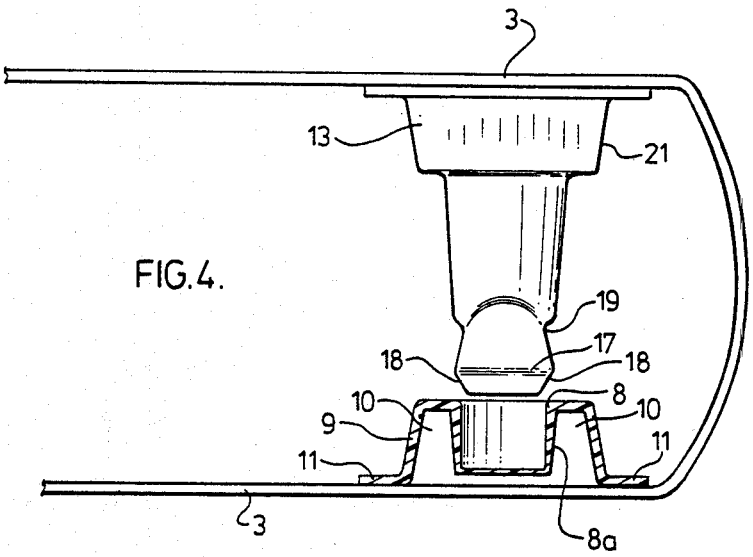

As will be clearly seen in the drawings, the width across each of the mouths is narrower than the width across the head which is to be inserted into the mouth. Furthermore, each of the mouths is elongated relative to each of the heads and will preferably be about two to four times the length of the head. As will also be seen in the drawings, particularly in FIG. 4, the lower interior wall 8A of the mouth is much thinner and therefore, weaker than the upper mouth wall 8, and therefore, weaker than both the upper mouth wall and the stiff head 17 on each of the posts.

Figure 5:
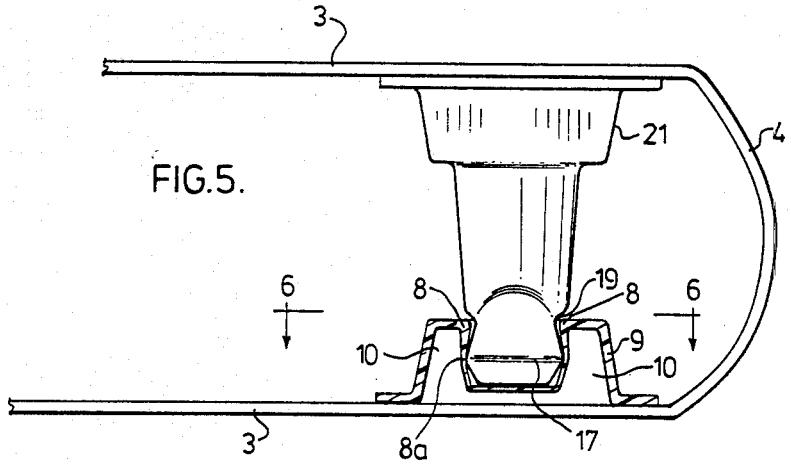
Figure 6:
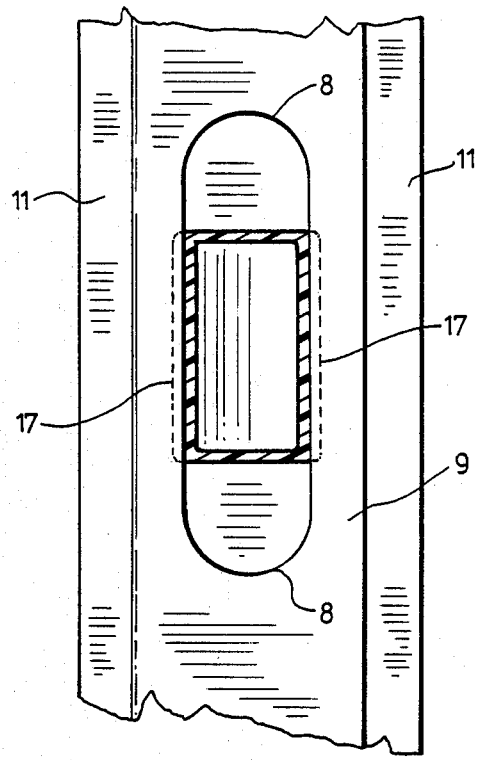
FIG. 6 is a sectional view taken along the line 6—6 of FIG. 5.

The file folder is quickly and easily loaded by simply laying the two panels open as shown in FIG. 2, so that a desired number of looseleaf pages can be slipped over posts 15. The folder is then closed and bound by folding the two panels about flexible spine 4, whereby posts 15 and openings 7 automatically align with one another. As will be appreciated, if for some reason or another, one of the panels is slightly skewed with respect to the other panel, the heads on the posts will still be aligned with some portion of the opposing elongated securing opening. In other words, the post head need not be centrally aligned with the mouth opening and will lock on either side of the center of the opening. The binding arrangement is snapped into a locking position by applying pressure from the outside of the folder on the two strips which forces each stiff post head provided with camming shoulders 18 through the more flexible mouth wall 8 of each opening. The head once having cleared beyond the upper mouth wall applies an outward pressure on the lower thinner and weaker interior wall 8A and forces wall 8A to move to the position shown in FIG. 5. At the same time, the upper thicker mouth wall 8 rebounds after having flexed laterally outwardly to permit passage of the head therethrough to the locking position where the peripheral mouthwall engages the undercut base 19 of head 17. As will be seen from FIGS. 4 and 5, a unique feature of the present invention, is that without actually having to provide an undercut in the receiving opening an undercut or dovetail type securing is achieved when the stiff head is fully inserted into the opening by the thinning down of interior wall 8A and due to the provision of cavities 10 which permit outward flexing of the thinned down walls when the head is snapped into the locking position.

The material from which the strips are formed ensures that both the heads of the posts and the mouth wall bounding each of the mouths are relatively stiff and neither one of these components is slotted or otherwise adapted to reduce the stiffness of the material itself. However, by elongating the mouth, the mouth wall is provided with a certain amount of flexibility or give with respect to the stiffer head without taking away from the stiffness of the actual material. This flexibility is however, kept at a relatively low level by making each of the mouths blind ended so that there is a wall at each end of the mouth to resist lateral opening of the mouth. The amount of resistance to lateral opening is determined by the length of the mouth and if each of the mouths were made into a continuous groove or recess the strength of the binding of the mouth wall on the head would be substantially reduced to a non-acceptable level. On the other hand, if the mount is made at the same length as the head, the mouth wall is much too stiff and will not have adequate give to permit insertion of the stiff head through the mouth without causing permanent damage to the mouth wall, the head, or both, which again, reduces the binding action to a non-acceptable level. The preferred PVC grade described above is therefore, particularly suitable because it provides stiffness at both the peripheral mouthwall and the head without being subject to premature breakdown.

A particularly suitable method of making both of the strips with their respective components is through vacuum forming. Furthermore, certain inherent characteristics of the vacuum forming process, lend themselves extremely well and provide particularly advantageous features according to the present invention. For example, in vacuum forming the posts on strip 13, the strength at the undercut base 19 is actually increased relative to the post head, even though the base is undercut. This feature which is totally in contrast with prior art arrangements which tend to easily break off at the base of the head, results from the fact that the material during vacuum forming is bunched in more tightly at the undercut base than it is at the head of the post. Therefore, the base of the head is extremely strong and effectively results breaking off of the head.

Figure 7:
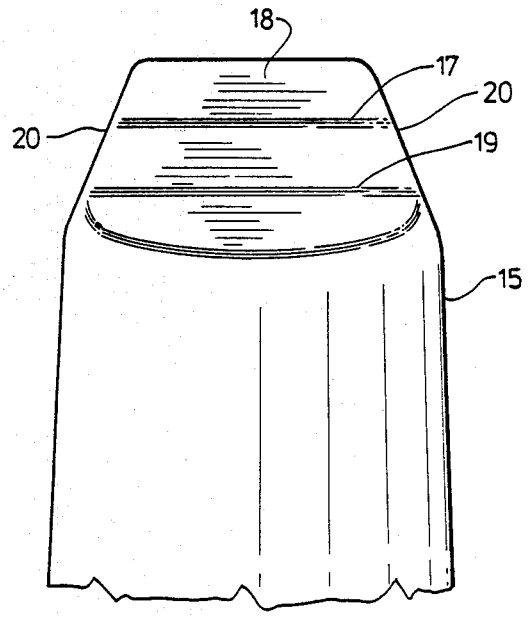
FIG. 7 is a side view of one of the binding posts.

As can be seen from the drawings, each of the post heads is only undercut along the sides of the post and not along the ends of the post. Furthermore, as is well shown in FIG. 7, the ends 20 of the post heads 17 are angled upwardly and inwardly to permit withdrawal of the post head from the vacuum forming mechanism. This angling of the head ends again, adds to the strength of the head as the angulation carries down beyond the undercut region 19. During vacuuming forming the material which is moved to the angular position again, tends to flow to the undercut region adding further material to the undercut base or neck of the post to add to its strength.

During the vacuum forming of strip 5, each of the openings is formed by drawing the material to the interior of the mouth which provides the thinning of the interior walls making them relatively weak compared to the peripheral mouth wall and the post head, resulting in the undercut simulation described above. If however, the strip were formed by die cutting there would not be any material below the mouthwall and the opening would in fact, have an undercut.

The binding system of the present invention is one which can be used with many different types of folders. However, when working with a single vinyl sheet as shown in the drawings, the two separate strips provide reinforcing at the spine while the spine itself, is formed by the flexible vinyl material to allow the required hinging action for opening and closing the folder. Furthermore, locating and securing the strips in place, is an extremely easy and inexpensive operation since only two pieces are required to be welded to the vinyl material. However, what particularly distinguishes the present invention over the prior art arrangements is the fact that the locking action which is extremely positive and characterised by a noticeable snapping of the head into the opening is performed through the interaction of two relatively stiff members, i.e. the post head and the peripheral mouth wall of the opening into which the post head is secured. No special shapes are required to form an undercut in the opening blow the peripheral mouth wall according to one preferred embodiment, due to the thinning of the interior walls as a result of an inherent vacuum forming characteristic. Also, of importance is the feature that the post head is secured by a reinforced base in which there is an actual gathering of material as opposed to the priro art structures in which material is removed from the posts to provide an undercut base beneath the post head so that such prior art structures are inherently weak at the base of the head.

Although various preferred embodiments of the invention have been described herein in detail, it will be appreciated by one skilled in the art that variations may be made thereto, without departing from the spirit of the invention or the scope of the appended claims.

The embodiments of the invention in which an exclusive property or privilege is claimed are defined as follows:

1. A binding system comprising a post provided with a head projecting from one side of said system and an opening having a blind ended mouth surrounded by opposing sidewalls and endwalls for releasably securing the head of said post at the other side of said system, said mouth being narrow and elongated relative to said head, said head being stiff for forceably opening said mouth during insertion therein and removal therefrom and having a base which is undercut only at its sides for receiving said sidewalls of said mouth when locked therein, the arrangement being adapted to provide outward lateral flexing of said sidewalls as said head is forced therethrough, with said endwalls of said mouth resisting the outward lateral flexing for inward lateral rebounding of said sidewalls at the undercut base of said head as said head clears beyond said sidewalls and is releasably secured within said opening.

2. A binding system comprising a first elongated strip having a plurality of posts projecting from one side of said system and a second elongated strip provided with a plurality of openings aligned with said posts at the other side of said system, each of said posts being provided with a head portion and each opening being provided with a blind ended mouth surrounded by sidewalls and endwalls for releasably securing the head of an aligned post, each mouth being narrow and elongated relative to its mating head with each head being stiff for forceably opening the mouth into which it is inserted and from which it is withdrawn and having a base which is undercut only at its sides for receiving the sidewalls of said mouth when the head is locked in the opening, the arrangement being adapted to provide outward lateral flexing of the sidewalls against resistance by the endwalls on each mouth as the head of each aligned post is forced therethrough and inward lateral rebounding of each sidewall at the undercut base of each head when releasably secured within its aligned opening.

3. A binding system as claimed in claim 2 comprising three posts and three aligned openings.

4. A binding system as claimed in claim 2, wherein each head is provided with cam means for camming through the mouth wall of each aligned opening.

5. A binding system as claimed in claim 2, wherein each of said openings is from two to four times the length of each head.

6. A binding system as claimed in claim 5 wherein said first and second strips are made from 20,000 PVC of frozen food grade.

7. A file folder comprising an elongated vinyl sheet with a pair of binding strips spaced slightly to either side of centre of said vinyl sheet, said strips being spaced slightly from one another for central folding of said sheet, one of said strips having a plurality of posts projecting therefrom, the other of said strips being provided with a plurality of openings aligned on said vinyl sheet with said posts, each of said posts being provided with a head portion and each opening being provided with a blind ended mouth surrounded by a continuous mouthwall having side and end portions for releasably securing the head of an aligned post, each mouth being narrow and elongated relative to its mating head with each head being stiff for forceably opening the mouth into which each head is inserted and from which each head is withdrawn and each head having a base which is undercut only at its sides for receiving the side portions of the mouthwall when the head is releasably locked in the opening, the arrangement being adapted to provide outward lateral flexing of the side portions of the mouthwall on each mouth as the head of each aligned post is forced therethrough against resistance from the end portions to the flexing for inward lateral rebounding of the side portions of each mouthwall at the undercut base of each head as each head clears to a position where the head is releasably secured within its aligned opening.

8. A file folder as claimed in claim 7 wherein said strips are heat sealed to said vinyl sheet.

9. A pair of vacuum formed strips for use in a binding system, each of said strips having a central vacuum formed ridge and a peripheral flange, one of said strips having a plurality of vacuum formed posts projecting outwardly from its ridge, the other of said strips being provided with a plurality of vacuum formed openings into its ridge, each of said posts being provided with a vacuum formed head portion and each opening being provided with a blind ended mouth surrounded by a peripheral mouthwall and an interior vacuum formed wall which is thin and flexible with respect to said peripheral mouthwall, each mouth being narrow and elongated relative to the heads on said one strip with each head being stiff for forceably opening the mouth into which it is inserted and from which it is withdrawn, each head having a side undercut base for receiving one of said mouthwalls when the head is locked in one of said openings, the arrangement being adapted to provide outward lateral flexing of the mouthwall on each mouth as the head of each post is forced therethrough and inward lateral rebounding of each mouthwall at the undercut base of each head when releasably secured within one of said openings.

10. A pair of strips as claimed in claim 9 including three posts on said one strip and three openings on said other strip, said openings and said posts being located at approximately the same positions on said strips.

11. A pair of strips as claimed in claim 9 wherein each of said posts includes camming side shoulders for camming through the mouth of its aligned opening.

12. A pair of strips as claimed in claim 11 wherein each of said posts includes angled end shoulders completely spanning the side undercut base at each end of the posts.

13. A vacuum formed strip for use in a binding system, said strip having a central vacuum formed ridge and a peripheral flange, said strip being provided with a plurality of vacuum formed openings in said ridge with each opening being provided with a blind ended mouth surrounded by a peripheral mouthwall and an interior vacuum formed wall which is thin and flexible with respect to said peripheral mouthwall, each mouth being narrow and elongated for receiving the head on a mating post which is of lesser length and greater width than the mouth.

* * * * *